US010393383B2

(12) United States Patent
Snyder

(10) Patent No.: US 10,393,383 B2
(45) Date of Patent: Aug. 27, 2019

(54) VARIABLE PORT ASSEMBLIES FOR WAVE ROTORS

(71) Applicant: Rolls-Royce North American Technologies, Inc., Indianapolis, IN (US)

(72) Inventor: Philip H Snyder, Avon, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 672 days.

(21) Appl. No.: 15/067,926

(22) Filed: Mar. 11, 2016

(65) Prior Publication Data

US 2016/0265783 A1 Sep. 15, 2016

Related U.S. Application Data

(60) Provisional application No. 62/132,610, filed on Mar. 13, 2015.

(51) Int. Cl.

| | |
|---|---|
| ***F23R 3/00*** | (2006.01) |
| ***F23R 3/56*** | (2006.01) |
| ***F04F 13/00*** | (2009.01) |

(52) U.S. Cl.

CPC ..... *F23R 3/56* (2013.01); *F04F 13/00* (2013.01)

(58) Field of Classification Search

CPC F23R 3/56; F23R 7/00; F05D 2240/35; F04F 13/00; F02C 5/00; F02C 5/02; F02C 5/06; F02C 5/08; F02C 5/10; F02C 5/11; F02C 5/12; F16K 31/524; F16K 31/52458; F16K 31/52475; F16K 3/0254; F16K 3/03; F16K 3/04

USPC ..... 60/39.34, 39.38, 39.78, 39.39; 251/229, 251/208, 251, 212, 298–301

See application file for complete search history.

(56) References Cited

U.S. PATENT DOCUMENTS

| | | | | |
|---|---|---|---|---|
| 2,930,196 A | | 3/1960 | Hertzberg et al. | |
| 3,164,318 A | | 1/1965 | John et al. | |
| 3,575,376 A | * | 4/1971 | Arvidson, Jr. | F16K 5/204 251/160 |
| 3,811,796 A | | 5/1974 | Coleman et al. | |
| 3,879,937 A | | 4/1975 | Baden et al. | |
| 4,002,414 A | * | 1/1977 | Coleman, Jr. | F02C 3/02 416/223 A |
| 4,398,868 A | | 8/1983 | Komauer et al. | |
| 4,662,342 A | * | 5/1987 | Altmann | F04F 13/00 123/559.2 |
| 5,069,600 A | | 12/1991 | Althaus et al. | |
| 5,267,432 A | | 12/1993 | Paxson | |

(Continued)

OTHER PUBLICATIONS

Akbari, Pejman, Recent Developments in Wave Rotor Combustion Technology and Future Perspectives: A Progress Review, Jul. 2007 (Year: 2007)*

(Continued)

*Primary Examiner* — Ted Kim
*Assistant Examiner* — Edwin Kang
(74) *Attorney, Agent, or Firm* — Barnes & Thornburg LLP

(57) ABSTRACT

A wave rotor combustor for use in a gas turbine engine includes an inlet assembly, a rotor drum, and an outlet assembly. The inlet assembly is arranged to direct a flow of gasses into rotor passages formed in the rotor drum. The rotor drum is arranged to receive the gasses. The outlet assembly is arranged to direct the gasses out of the rotor drum.

20 Claims, 9 Drawing Sheets

(56) References Cited

U.S. PATENT DOCUMENTS

| | | | | |
|---|---|---|---|---|
| 5,916,125 | A | 6/1999 | Snyder | |
| 6,351,934 | B2 | 3/2002 | Snyder | |
| 6,439,209 | B1 * | 8/2002 | Wenger | F01N 3/20 123/559.2 |
| 6,449,939 | B1 | 9/2002 | Snyder | |
| 6,845,620 | B2 | 1/2005 | Nalim | |
| 6,988,493 | B2 | 1/2006 | Wenger et al. | |
| 7,137,243 | B2 | 11/2006 | Snyder et al. | |
| 7,520,123 | B2 | 4/2009 | Saddoughi et al. | |
| 7,621,118 | B2 | 11/2009 | Snyder et al. | |
| 7,891,164 | B2 | 2/2011 | Janssen et al. | |
| 8,117,828 | B2 | 2/2012 | Snyder et al. | |
| 2012/0216503 | A1 | 8/2012 | Snyder | |
| 2012/0216504 | A1 | 8/2012 | Snyder | |

OTHER PUBLICATIONS

Woodford, How do cranks and cams work?, Jul. 2, 2012 (Year: 2012).*

* cited by examiner

VARIABLE PORT ASSEMBLIES FOR WAVE ROTORS

CROSS REFERENCE TO RELATED APPLICATIONS

This application claims priority to and the benefit of U.S. Provisional Patent Application No. 62/132,610, filed 13 Mar. 2015, the disclosure of which is now expressly incorporated herein by reference.

FIELD OF THE DISCLOSURE

The present disclosure relates generally to wave rotors, and more specifically to port assemblies used with wave rotors.

BACKGROUND

Gas turbine engines are used to power aircraft, watercraft, power generators, and the like. Gas turbine engines typically include a compressor, a combustor, and a turbine. The compressor compresses air drawn into the engine and delivers high-pressure air to the combustor. In the combustor, fuel is mixed with the high-pressure air and is ignited. Products of the combustion reaction in the combustor are directed into the turbine where work is extracted to drive the compressor and, sometimes, an output shaft. Leftover products of the combustion are exhausted out of the turbine and may provide thrust in some applications.

In some applications, wave rotor combustors ignite air and fuel as part of an engine core that powers a fan assembly or a drive shaft of the engine. Typical wave rotor combustors include an inlet assembly, an outlet assembly spaced apart from the inlet assembly along a central axis of the wave rotor combustor, and a rotor drum positioned therebetween. The inlet assembly directs a flow of air and fuel into rotor passages formed in the rotor drum. The rotor drum receives and combusts the fuel-air mixture to produce hot high-pressure products as part of a combustion process as the rotor drum rotates about the central axis relative to the inlet assembly and the outlet assembly. The outlet assembly directs the hot high-pressure products out of the rotor drum into the turbine.

SUMMARY

The present disclosure may comprise one or more of the following features and combinations thereof.

A wave rotor combustor may include a rotor drum and an inlet assembly. The rotor drum may be mounted for rotation about a central axis of the wave rotor combustor. The rotor drum may be formed to include a plurality of rotor passages that extend along the central axis. The inlet assembly may include a seal plate formed to include an inlet port extending axially through the seal plate along an arc around the central axis, a restrictor plate coupled to the seal plate to pivot about the central axis relative to the seal plate to cover selectively a portion of the inlet port and vary an area of the inlet port for flow to pass through the seal plate, and a restrictor-plate mover mounted to translate radially inwardly and outwardly relative to the central axis. The restrictor-plate mover may be arranged to engage the restrictor plate during translation to cause the restrictor plate to pivot relative to the seal plate.

In some embodiments, the restrictor-plate mover may include a mover surface engaged with the restrictor plate. The mover surface may be curved.

In some embodiments, a restrictor surface of the restrictor plate may be engaged by the mover surface. The restrictor surface may be continuous and curved.

In some embodiments, the restrictor-plate mover may include a mover surface. The restrictor plate may include a restrictor surface. The restrictor surface may be engaged by the mover surface without forming a gap therebetween.

In some embodiments, the seal plate may be formed to include a restrictor cutout. The restrictor plate may be received in the restrictor cutout. In some embodiments, at least a portion of the restrictor-plate mover may be received in the restrictor cutout.

In some embodiments, the seal plate may include a forward face and an aft face spaced apart from the forward face. The restrictor cutout may extend into the aft face of the seal plate toward the forward face of the seal plate.

In some embodiments, the restrictor plate may include an inner restrictor face and an outer restrictor face. The restrictor plate may be received in the restrictor cutout to cause the outer restrictor face of the restrictor plate and the aft face of the seal plate to lie in a common plane. In some embodiments, the restrictor cutout may be sized to limit movement of the restrictor plate about the central axis to a predetermined number of positions.

In some embodiments, the seal plate may be formed to include a restrictor cutout. The restrictor plate may be received in the restrictor cutout. At least a portion of the restrictor-plate mover may be received in the restrictor cutout.

In some embodiments, the seal plate may include a forward face, an aft face spaced apart from the forward face, and a restrictor cutout extending into the aft face of the seal plate toward the forward face of the seal plate. The restrictor plate may be received in the restrictor cutout and located axially between the rotor drum and the seal plate relative to the central axis.

According to another aspect of the present disclosure, a port assembly may include a seal plate, a restrictor plate, and a restrictor-plate mover. The seal plate may be formed to include a port extending axially through the seal plate along an arc around a central axis of the port assembly. The restrictor plate may be coupled to the seal plate to move relative to the seal plate to cover selectively a portion of the port and vary an area of the port to control a flow arranged to pass through the seal plate. The restrictor-plate mover may be mounted to the seal plate to translate radially inwardly and outwardly relative to the central axis and the restrictor-plate mover arranged to engage the restrictor plate during translation to cause the restrictor plate to move relative to the seal plate.

In some embodiments, the restrictor-plate mover may include a mover surface. The restrictor plate may include a restrictor surface. The restrictor surface may mate with the mover surface without forming a gap therebetween for a number of positions of the restrictor plate as the restrictor plate moves relative to the seal plate.

In some embodiments, the seal plate may be formed to include a restrictor cutout. The restrictor plate may be received in the restrictor cutout.

In some embodiments, at least a portion of the restrictor-plate mover may be received in the restrictor cutout. In some embodiments, the restrictor cutout may be sized to limit movement of the restrictor plate about the central axis to a predetermined number of positions.

In some embodiments, the seal plate may include a forward face and an aft face spaced apart from the forward face. The restrictor cutout may extend into the aft face of the seal plate toward the forward face of the seal plate.

In some embodiments, the restrictor plate may include an inner restrictor face and an outer restrictor face. The restrictor plate may be received in the restrictor cutout to cause the outer restrictor face of the restrictor plate and the aft face of the seal plate to lie in a common plane.

In some embodiments, the restrictor plate may be arranged to pivot about the central axis between an open position in which the port is fully open and a closed position in which the restrictor plate covers a portion of the port to partially close the port. The restrictor-plate mover may move between an outer position and an inner position to cause the restrictor plate to pivot between the open and closed positions.

According to another aspect of the present disclosure, a method of using a port assembly may include a number of steps. The method may include providing a seal plate formed to include a port extending axially through the seal plate along an arc around a central axis of the port assembly, a restrictor plate coupled to the seal plate and arranged to pivot about the central axis relative to the seal plate, and a restrictor-plate mover engaged with the restrictor plate and translating the restrictor-plate mover radially relative to the central axis to cause the restrictor plate to pivot about the central axis relative to the seal plate and cover selectively a portion of the port to vary an area of the port.

These and other features of the present disclosure will become more apparent from the following description of the illustrative embodiments.

DETAILED DESCRIPTION OF THE DRAWINGS

Figure 1:
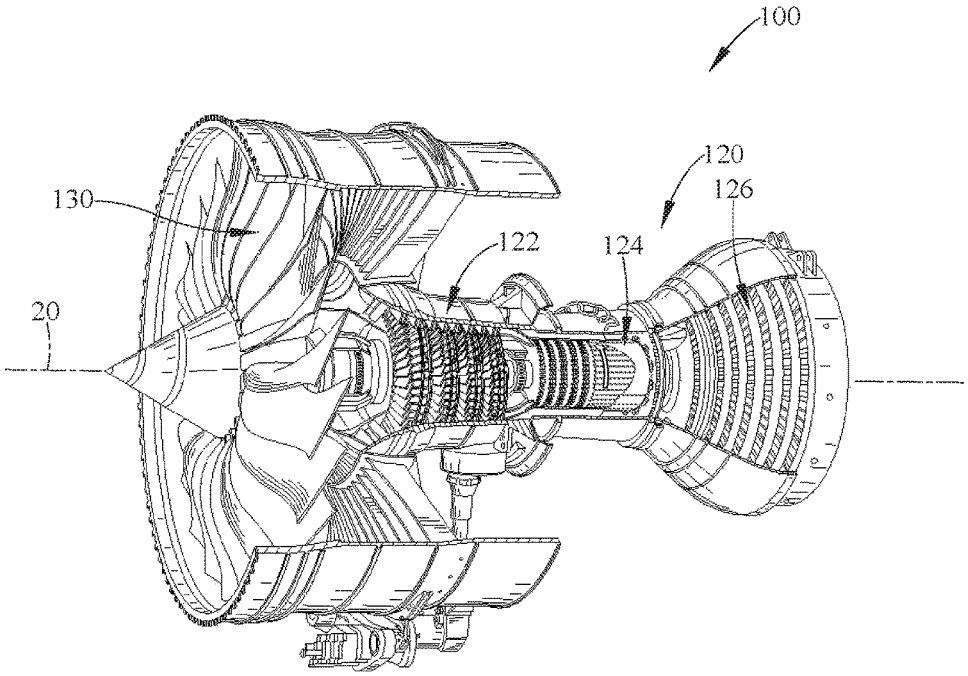
FIG. 1 is a cutaway view of a gas turbine engine including a wave rotor combustor arranged to receive fuel and air and to ignite the fuel-air mixture to produce hot high-pressure products that are directed into a turbine to drive the engine.

For the purposes of promoting an understanding of the principles of the disclosure, reference will now be made to a number of illustrative embodiments illustrated in the drawings and specific language will be used to describe the same.

An illustrative aerospace gas turbine engine 100 includes a wave rotor combustor 124 as part of an engine core 120 that powers a fan assembly 130 as shown in FIG. 1. The wave rotor combustor 124 is configured to receive a flow of fuel and air and to ignite the fueled air 354 to power the engine core 120. The wave rotor combustor 124 is an illustrative use of a wave rotor. In other embodiments, the disclosed features may be included in wave rotors used as pressure exchangers, flow dividers, flow combiners, etc. Such wave rotors may or may not include a combustion process. The features of the present disclosure may be used with many different wave rotors, including combustors, pressure exchangers, flow dividers, flow combiners, etc.

Figure 5:
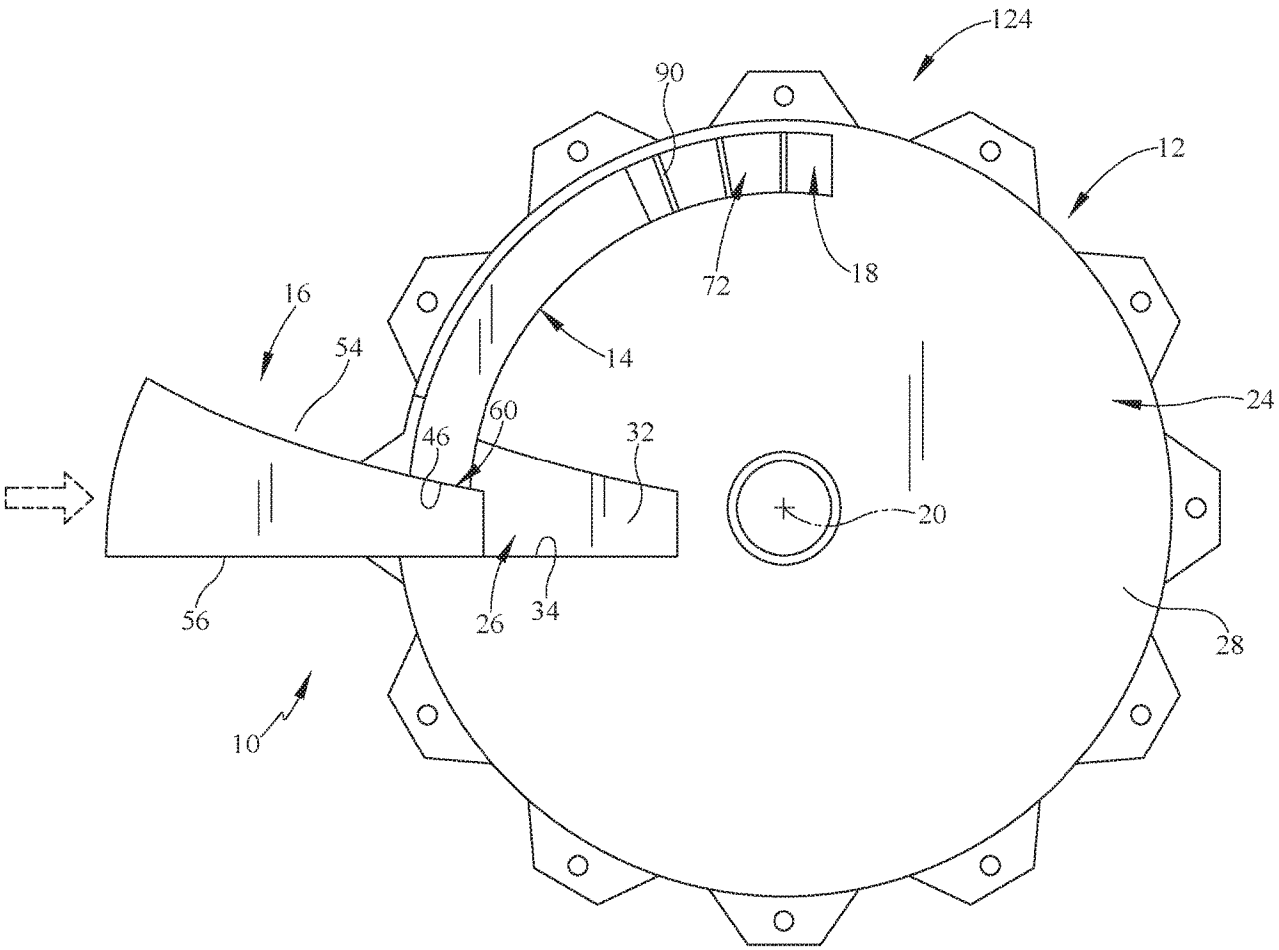
FIG. 5 is an elevation view of the inlet assembly showing the restrictor plate in a first position relative to the seal plate so that the inlet port is fully open and suggesting that the restrictor-plate mover may translate to the right to cause the restrictor plate to move relative to the seal plate to cover a portion of the inlet port and vary the area of the inlet port.
Figure 6:
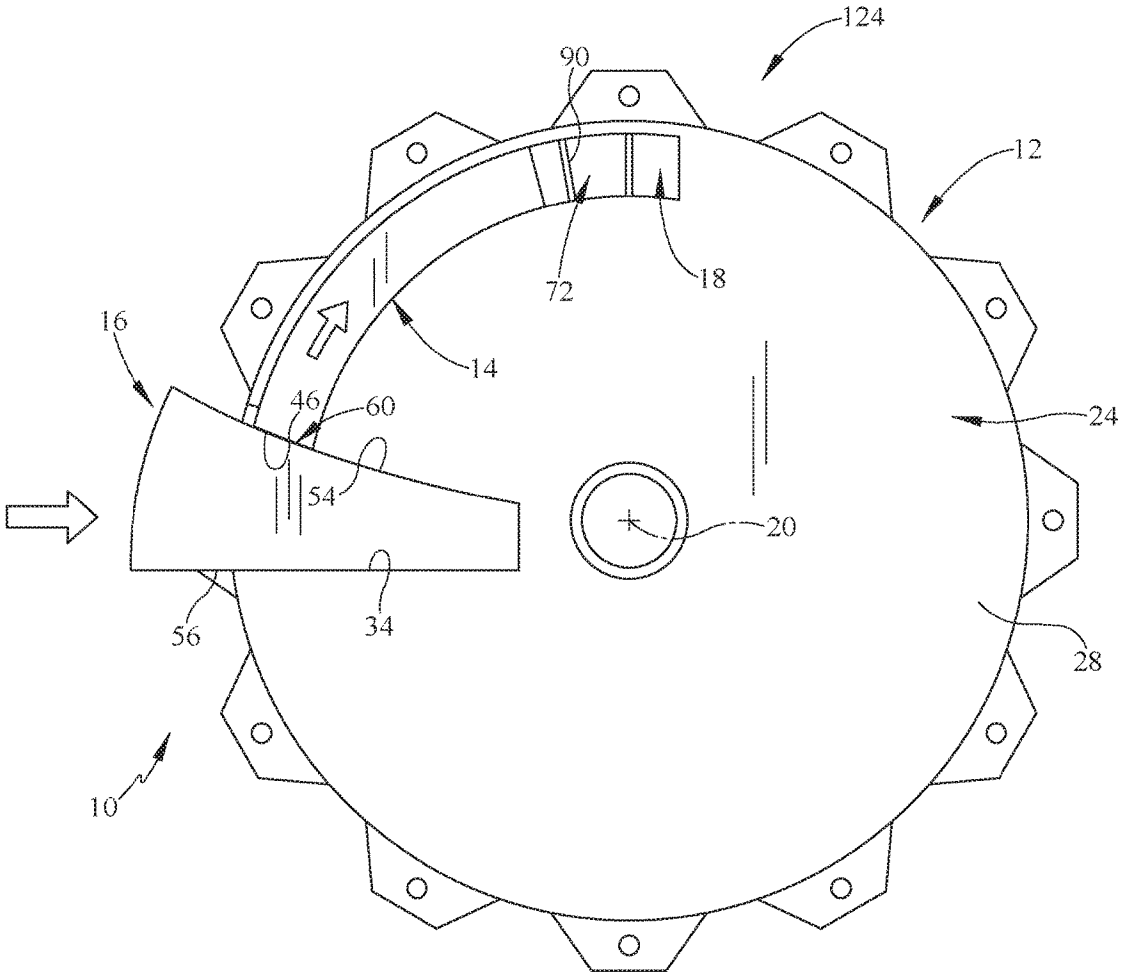
FIG. 6 is an elevation view of the inlet assembly showing that the restrictor-plate mover has been moved to the right and, as a result, the restrictor plate has moved relative to the seal plate to cause the inlet port to be partially closed.

The wave rotor combustor 124 illustratively includes a port assembly, illustratively an inlet assembly 10, arranged to vary a size of the port to adjust the flow of fuel and air directed into and out of the wave rotor combustor 124 as suggested in FIGS. 5 and 6. In other embodiments, an outlet assembly 82 may be variable, while in other embodiments, both the inlet and outlet assemblies 10, 82 may be variable.

Variable ports allow the wave rotor combustor 124 and the combustion processes within the wave rotor combustor 124 to be adjusted after the wave rotor combustor 124 has been assembled and/or installed into the engine 100. This allows the combustion process to be adjusted to better match the operating conditions of the engine 100. Additionally, variable ports may allow for a larger range of operating conditions.

Figure 2:
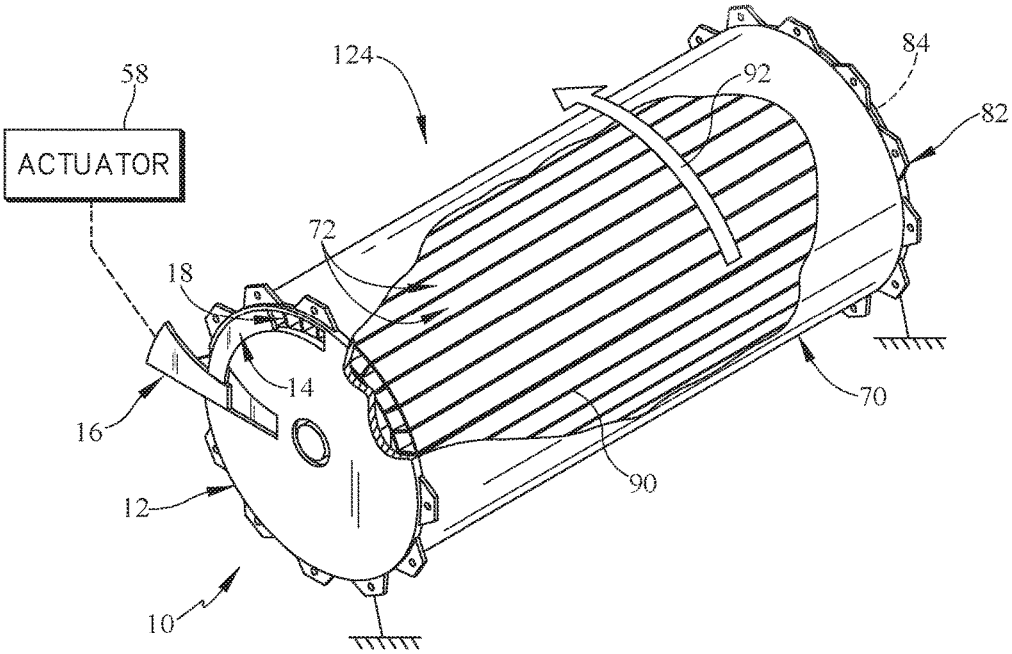
FIG. 2 is a cutaway view of the wave rotor combustor included in the gas turbine engine of FIG. 1 showing that the wave rotor combustor includes, from left to right, an inlet assembly having a variable inlet port for adjusting parameters of the wave rotor combustor, a rotor drum formed to include a plurality of rotor passages arranged to rotate about a central axis of the wave rotor combustor relative to the inlet assembly, and an outlet assembly.
Figure 3:
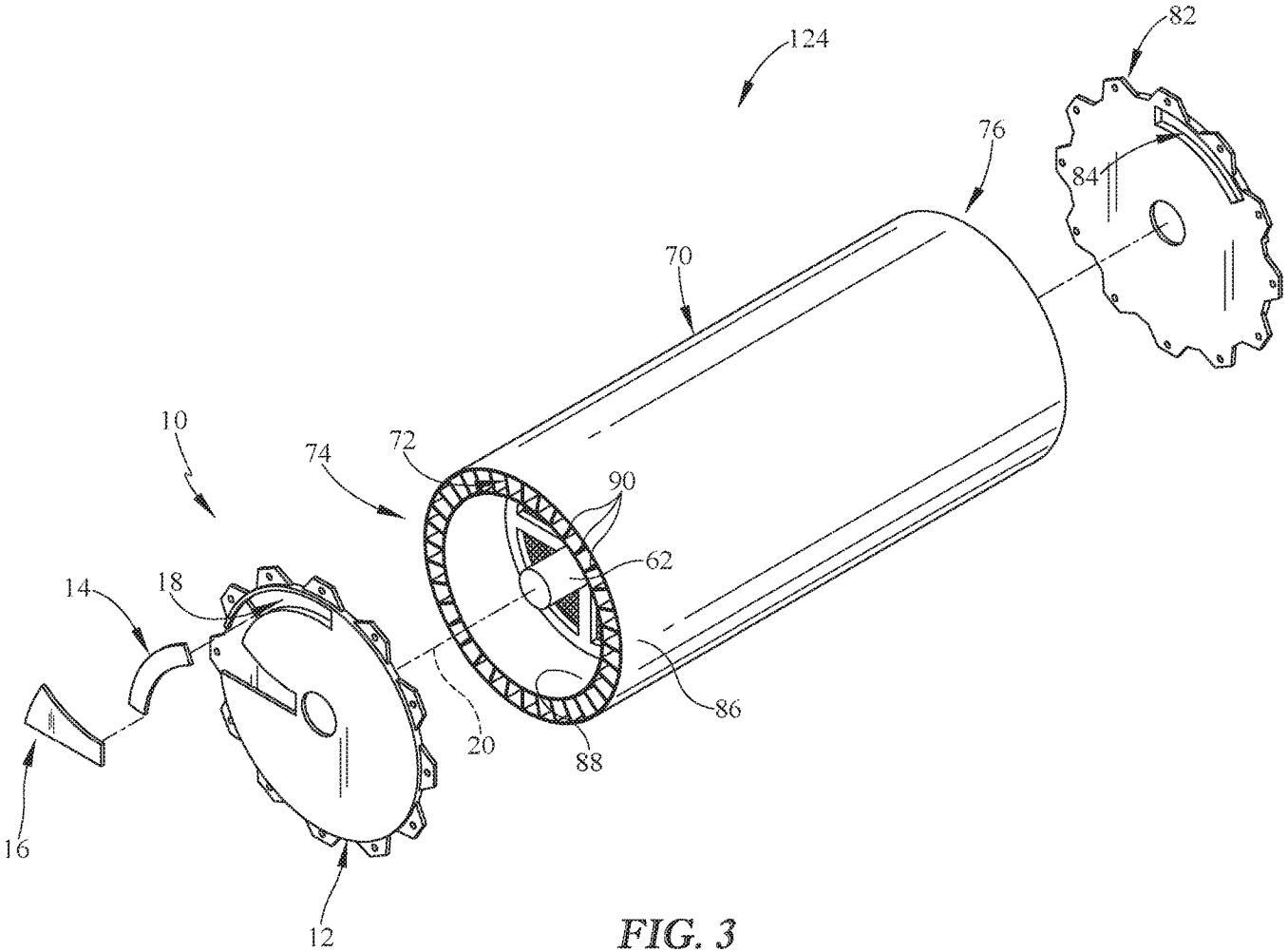
FIG. 3 is an exploded view of the wave rotor combustor showing that the wave rotor combustor includes, from left to right, the a variable inlet assembly arranged to vary an area of the inlet, the rotor drum arranged to rotate relative to the inlet assembly and the outlet assembly to cause the rotor passages to receive, combust, and exhaust the fuel-air mixture as part of a combustion process, and the outlet assembly arranged to direct the hot high-pressure products of the combustion process out of the rotor passages into the turbine.

In the illustrative embodiment, the wave rotor combustor 124 is configured to use transient internal fluid flow to compress fuel and air prior to combustion to improve the efficiency of combustion within the wave rotor combustor 124. The wave rotor combustor 124 illustratively includes the inlet assembly 10, an outlet assembly 82 spaced apart from the inlet assembly 10 along a central axis 20 of the engine 100, and a rotor drum 70 positioned therebetween as shown in FIGS. 2 and 3.

The inlet assembly 10 is arranged to regulate the flow of air and fuel into rotor passages 72 formed in the rotor drum 70. The rotor drum 70 is arranged to receive and combust the fueled air 354 to produce hot high-pressure products as part of a combustion process 300 as the rotor drum 70 rotates about the central axis 20 relative to the inlet assembly 10 and the outlet assembly 82. The outlet assembly 82 is arranged to direct the hot high-pressure products out of the rotor drum 70 into a turbine 126 included in the engine 100 as shown in FIG. 1.

Figure 4:
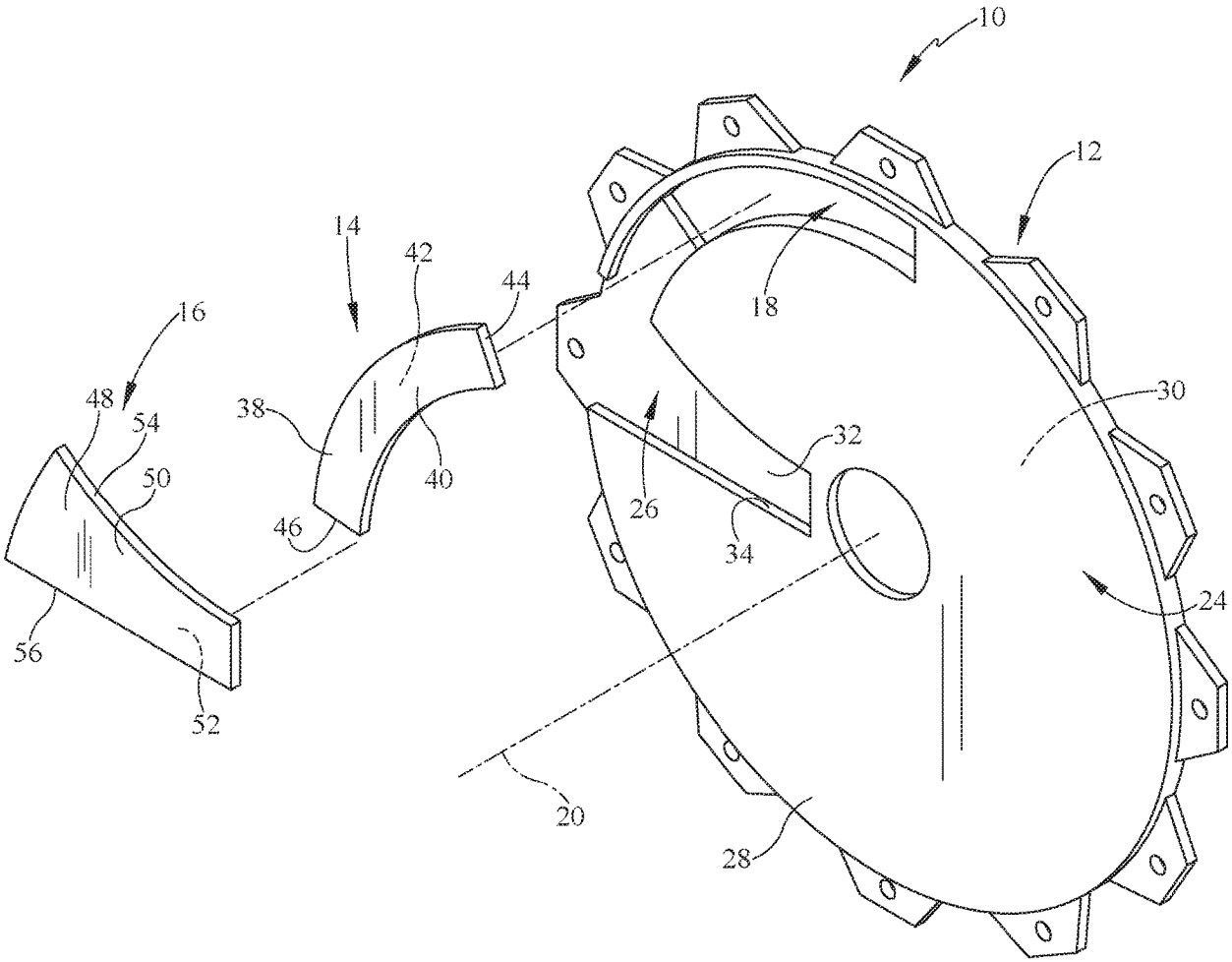
FIG. 4 is an exploded view of the inlet assembly included in the wave rotor combustor showing that the inlet assembly includes, from right to left, a seal plate formed to include the inlet port for directing the flow of air and fuel into the rotor passages, a restrictor plate arranged to move relative to the seal plate to vary the size of the inlet port, and a restrictor-plate mover arranged to engage the restrictor plate to cause the restrictor plate to move relative to the seal plate.

In the illustrative embodiment, the inlet assembly 10 is a variable inlet assembly 10 adapted to vary a size of the inlet port 18 opening into the rotor drum 70. In other embodiments, other ports such as, for example, the outlet port 84 may be variable. The inlet assembly 10 includes a seal plate 12, a restrictor plate 14, and a restrictor-plate mover 16 as shown in FIGS. 2 and 4. The seal plate 12 is formed to include the inlet port 18 that extends axially through the seal plate 12 along an arc around the central axis 20. The restrictor plate 14 is coupled to the seal plate 12 to move about the central axis 20 relative to the seal plate 12 to cover selectively a portion of the inlet port 18 and vary an area of the inlet port 18 for flow to pass through the seal plate 12 into the rotor passages 72. The restrictor-plate mover 16 is arranged to engage the restrictor plate 14 and move relative to the seal plate 12 and the restrictor plate 14 to cause the restrictor plate 14 to move relative to the seal plate 12.

The seal plate 12 includes a seal body 24 and the inlet port 18 as shown in FIG. 4. The seal body 24 is arranged to close an inlet end 74 of the rotor passages 72. The inlet port 18 is arranged to direct the flow of air and fuel into rotor passages 72 that are aligned circumferentially with the inlet port 18.

The seal body 24 includes a forward face 28 and an aft face 30 spaced apart axially from the forward face 28. The forward face 28 faces a compressor 122 included in the engine 100 as shown in FIG. 1. The aft face 30 faces the rotor drum 70 as shown in FIG. 4. In the illustrative embodiment, the seal body 24 is circular when viewed along the central axis 20. In the illustrative embodiment, the seal body 24 further includes a plurality of flanges. The flanges are arranged to receive fasteners to couple the seal body 24 to the engine core 120 to block rotation of the seal plate 12 relative to the central axis 20.

The inlet port 18 extends through the seal body 24 as shown in FIG. 4. The inlet port 18 extends axially relative to the central axis 20 between the forward face 28 and the aft face 30. The inlet port 18 extends circumferentially along an arc around the central axis 20. In the illustrative embodiment, the inlet port 18 extends circumferentially around the central axis 20 in about a 45-degree arc. As the rotor passages 72 rotate about the central axis 20, the inlet port 18 allows an upstream flow of air and fuel to pass through the seal plate 12 into each rotor passage 72 while the rotor passage 72 is aligned with the inlet port 18.

In the illustrative embodiment, the seal plate 12 further includes a restrictor cutout 26 as shown in FIG. 4. The restrictor cutout 26 extends axially into the seal body 24 and is arranged to receive the restrictor plate 14 and the restrictor-plate mover 16. In the illustrative embodiment, the restrictor cutout 26 extends into the forward face 28 of the seal plate 12 toward the aft face 30 of the seal plate 12. In some embodiments, the restrictor cutout 26 is sized to limit movement of the restrictor plate 14 relative to the seal plate 12 to a predetermined number of positions.

Figure 7:
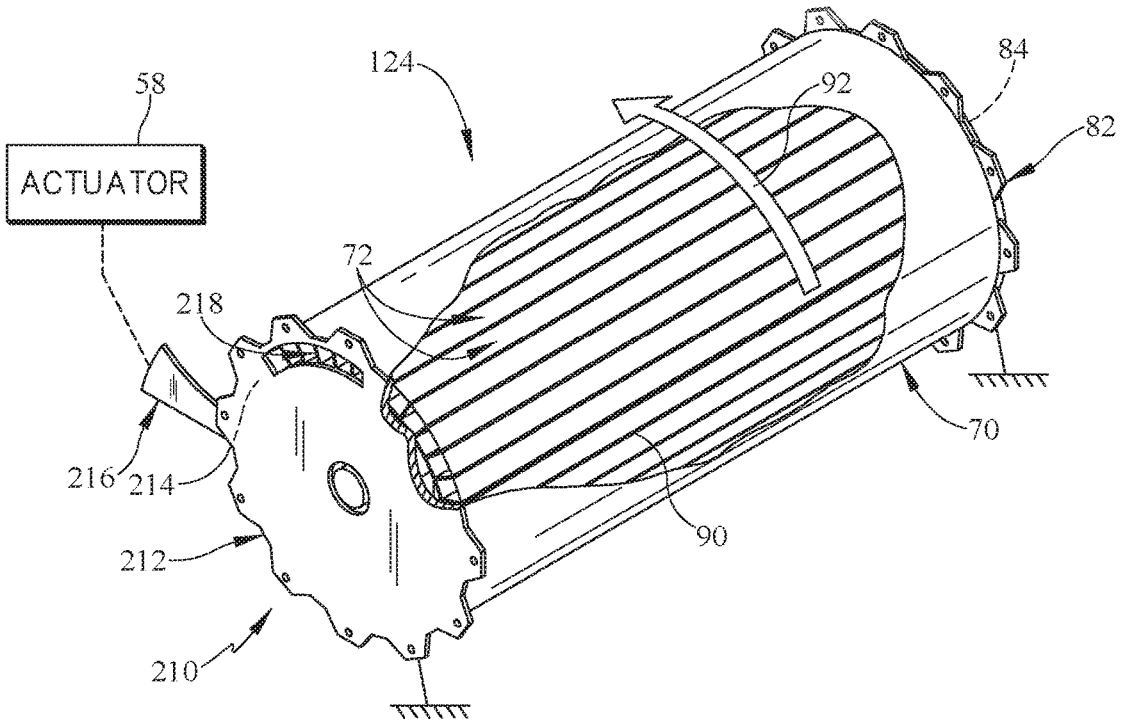
FIG. 7 is a cutaway view of another embodiment of a wave rotor combustor showing that the wave rotor combustor includes, from left to right, an inlet assembly having a variable inlet port, a rotor drum formed to include a plurality of rotor passages arranged to rotate about a central axis of the wave rotor combustor relative to the inlet assembly, and an outlet assembly.
Figure 8:
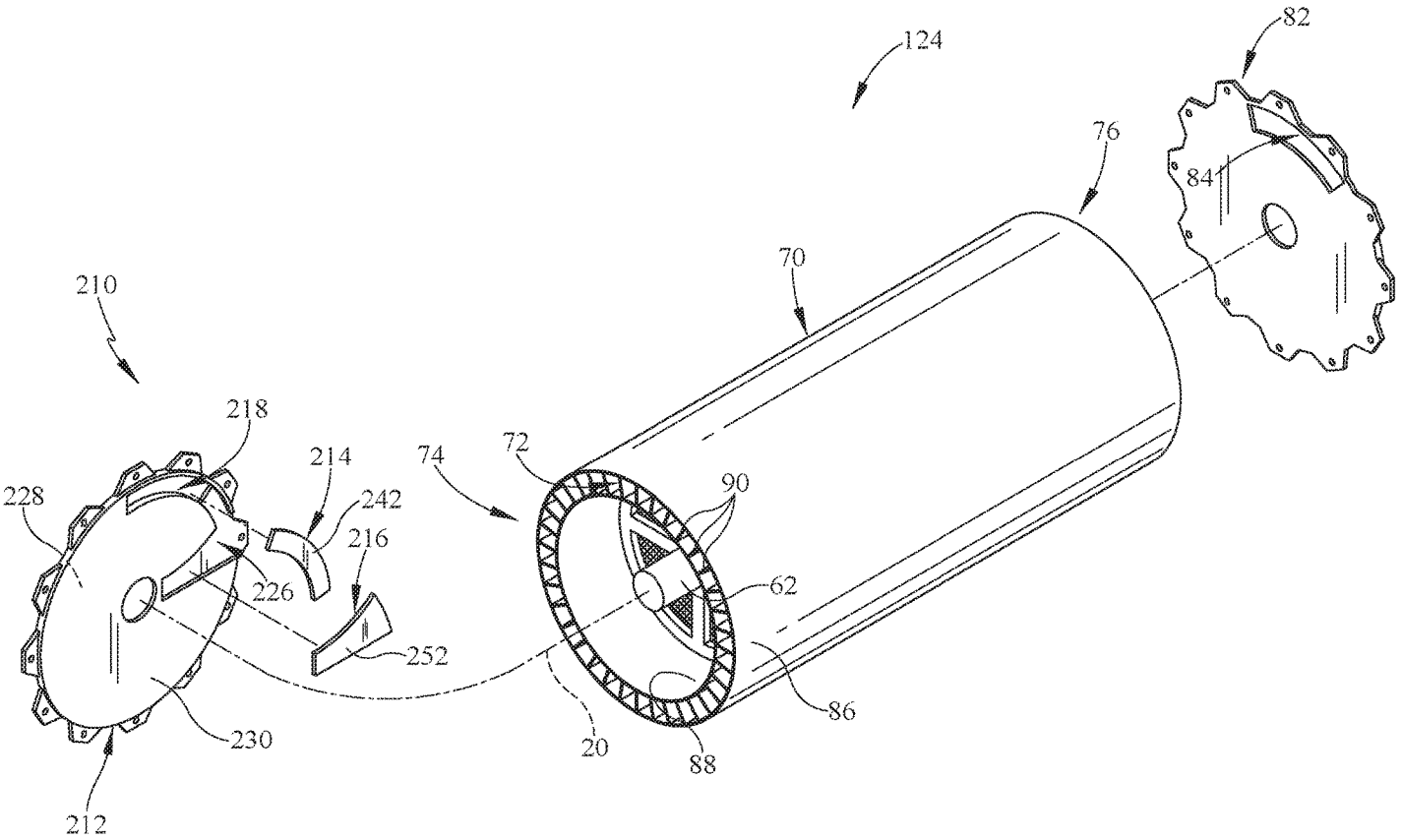
FIG. 8 is an exploded view of the wave rotor combustor of FIG. 7 showing that the wave rotor combustor includes, from left to right, the inlet assembly, the rotor drum arranged to rotate relative to the inlet assembly and the outlet assembly to cause the rotor passages to receive, combust, and exhaust the fuel-air mixture as part of a combustion process, and the outlet assembly arranged to direct the hot high-pressure products of the combustion process out of the rotor passages into the turbine.

In other embodiments, the restrictor plate 14 and the restrictor-plate mover 16 are positioned between the seal body 24 and the rotor drum 70 as shown in FIG. 7. In such embodiments, the restrictor cutout 26 extends into the aft face 30 toward the forward face 28 as shown in FIGS. 7 and 8.

In the illustrative embodiment, the seal body 24 further includes an intermediate face 32 and a support surface 34 as shown in FIG. 4. The intermediate face 32 is located axially between the forward face 28 and the aft face 30. The support surface 34 extends between and interconnects the intermediate face 32 and the forward face 28. In the illustrative embodiment, the forward face 28, intermediate face 32, and the support surface 34 cooperate to define the restrictor cutout 26.

The restrictor plate 14 is arranged to selectively cover a portion of the inlet port 18 as suggested in FIGS. 5 and 6. In the illustrative embodiment, the restrictor plate 14 is arranged to pivot about the central axis 20 to cause the restrictor plate 14 to cover a portion of the inlet port 18. The restrictor plate 14 is engaged by the restrictor-plate mover 16 to cause the restrictor plate 14 to pivot about the central axis 20 in a first direction. When the restrictor-plate mover 16 is moved away from the central axis 20, the restrictor plate 14 pivots about the central axis 20 in a second direction to uncover a portion of the inlet port 18. In other embodiments, the restrictor plate 14 may translate, slide, and/or pivot relative to the seal plate 12 to cover and uncover the inlet port 18.

In the illustrative embodiment, the restrictor plate 14 is arcuate as shown in FIG. 4. The restrictor plate 14 includes a restrictor body 38, an inner restrictor face 40, and an outer restrictor face 42, a first restrictor surface 44, and a second restrictor surface 46 as shown in FIG. 4. The restrictor body 38 extends axially along the central axis 20 between the inner restrictor face 40 and the outer restrictor face 42. The first restrictor surface 44 extends radially and interconnects the inner and outer restrictor faces 40, 42 at a first end of the restrictor plate 14. The second restrictor surface 46 extends radially and interconnects the inner and outer restrictor faces 40, 42 at a second end of the restrictor plate 14.

In the illustrative embodiment, the second restrictor surface 46 is continuous and linear. In other embodiments, the second restrictor surface 46 may be curved. In the illustrative embodiment, the restrictor plate 14 is received in the restrictor cutout 26 as shown in FIGS. 2 and 5. In the illustrative embodiment, the inner restrictor face 40 and the outer restrictor face 42 are generally flat. The outer restrictor face 42 faces the seal plate 12 and the inner restrictor face 40 faces away from the seal plate 12. The inner restrictor face 40 of the restrictor plate 14 and the forward face 28 included in the seal plate 12 lie in a common plane. In embodiments where the restrictor plate 14 is positioned between the seal plate 12 and the rotor drum 70, the inner restrictor face 40 and the forward face 28 provide a desired dimensional tolerance between the inlet assembly 10 and the rotor passages 72 as shown in FIG. 7.

The restrictor-plate mover 16 engages the restrictor plate 14 to cause the restrictor plate 14 to pivot about the central axis 20 and cover selectively the inlet port 18 as suggested in FIGS. 5 and 6. The restrictor-plate mover 16 includes a mover body 48, an inner mover face 50, an outer mover face 52, a first mover surface 54, and a second mover surface 56 as shown in FIG. 4.

The outer mover face 52 faces the seal plate 12. The inner mover face 50 is spaced apart axially from the outer mover face 52 and faces away from the seal plate 12. The mover body 48 extends axially between the inner mover face 50 and the outer mover face 52.

In the illustrative embodiment, the inner mover face 50 of the restrictor-plate mover 16 and the forward face 28 included in the seal plate 12 lie in a common plane. In embodiments where the restrictor-plate mover 16 is positioned between the seal plate 12 and the rotor drum 70, inner mover face 50 and the forward face 28 provide a desired dimensional tolerance between the inlet assembly 10 and the rotor passages 72.

The first mover surface 54 extends radially and interconnects the inner mover face 50 and the outer mover face 52 at a first end of the restrictor-plate mover 16 as shown in FIG. 4. The first mover surface 54 engages the second restrictor surface 46 included in the restrictor plate 14 as shown in FIGS. 5 and 6. As the restrictor-plate mover 16 translates along the support surface 34, the first mover surface 54 applies a force to the restrictor plate 14 to cause the restrictor plate 14 to pivot about the central axis 20.

A gap 60 may be formed between the first mover surface 54 and the second restrictor surface 46. In the illustrative embodiment, the first mover surface 54 is curved. The curved first mover surface 54 is arranged to minimize the gap 60 as the restrictor-plate mover 16 translates along the support surface 34. As such, the gap 60 is minimized for each position of the restrictor plate 14. In some embodiment, the first mover surface 54 and the second restrictor surface 46 are formed such that no gap 60 is formed between the restrictor plate 14 and the restrictor-plate mover 16 for all positions of the restrictor plate 14. In other embodiments, the first mover surface 54 is continuous and linear.

The second mover surface 56 extends radially and interconnects the inner mover face 50 and the outer mover face 52 at a second end of the restrictor-plate mover 16. The second mover surface 56 engages the support surface 34 formed in the seal plate 12 as shown in FIGS. 5 and 6. In the illustrative embodiment, the second mover surface 56 moves along the support surface 34 to cause the restrictor-plate mover 16 to translate relative to the seal plate 12. In the illustrative embodiment, an actuator 58 is coupled to the restrictor-plate mover 16 as shown diagrammatically in FIG. 2. The actuator 58 is arranged to move the restrictor-plate mover 16 radially inward and outward along the support surface 34. In other embodiments, the actuator 58 is coupled to the restrictor-plate mover 16 and a second actuator is coupled to the restrictor plate 14. The second actuator is arranged to move the restrictor plate 14 relative to the seal plate 12. In some embodiments, a second actuator is coupled to the restrictor plate 14 and the actuator 58 is omitted. In some embodiments, movement of the restrictor plate 14 by the second actuator causes the restrictor-plate mover 16 to move relative to the seal plate 12.

The restrictor plate 14 pivots about the central axis 20 between an open position in which the inlet port 18 is fully open as shown in FIG. 5 and a closed position in which the restrictor plate 14 covers a portion of the inlet port 18 to partially close the inlet port 18 as shown in FIG. 6. The restrictor-plate mover 16 is arranged to move between an outer position and an inner position to cause the restrictor plate 14 to pivot between the open and closed positions as suggested in FIGS. 5 and 6. In other embodiments, the restrictor-plate mover 16 is arranged to move between an outer position and an inner position to cause the restrictor plate 14 to move between the open and closed positions such as, for example, by translating, sliding, and/or pivoting.

In operation, the restrictor-plate mover 16 is moved radially outward away from the central axis 20 to the outer position to increase the area of the inlet port 18 as shown in FIG. 5. As such, the inlet port 18 is fully uncovered by the restrictor plate 14.

The restrictor-plate mover 16 is translated along the support surface 34 toward the central axis 20 to the inner position to cover a portion of the inlet port 18 as suggested in FIG. 6. In the illustrative embodiment, the actuator 58 causes the restrictor-plate mover 16 to translate. As the restrictor-plate mover 16 translates, the first mover surface 54 engages the second restrictor surface 46 of the restrictor plate 14 to cause the restrictor plate 14 to pivot about the central axis 20 in the first direction. As the restrictor plate 14 pivots about the central axis 20, the restrictor plate 14 covers the inlet port 18.

The actuator 58 is configured to translate the restrictor-plate mover 16 away from the central axis 20. As the restrictor-plate mover 16 translates away from the central axis 20, the restrictor plate 14 pivots about the central axis 20 in the second direction to uncover a portion of the inlet port 18. In some embodiments, the restrictor plate 14 is omitted and the restrictor-plate mover 16 is sized to cover a portion of the port as the restrictor-plate mover 16 moves relative to the seal plate 12.

Another illustrative inlet assembly 210 for use in the wave rotor combustor 124 is shown in FIGS. 7 and 8. The inlet assembly 210 is substantially similar to the inlet assembly 10 shown in FIGS. 1-6 and described herein. Accordingly, similar reference numbers in the 200 series indicate features that are common between the inlet assembly 10 and the inlet assembly 210. The description of the inlet assembly 10 is hereby incorporated by reference to apply to the inlet assembly 210, except in instances when it conflicts with the specific description and drawings of the inlet assembly 210.

In the illustrative embodiment, the restrictor cutout 226 formed in the seal plate 212 extends into the aft face 230 toward the forward face 228 as shown in FIG. 8. The restrictor plate 214 and the restrictor-plate mover 216 are received in the restrictor cutout 226 and are positioned between the seal plate 212 and the rotor drum 70 as shown in FIGS. 7 and 8. The aft face 230 of the seal plate 212, the outer restrictor face 242 of the restrictor plate 214, and the outer mover face 252 of the restrictor-plate mover 216 cooperate to block the inlet end 74 of the rotor drum 70. Illustratively, the aft face 230 of the seal plate 212, the outer restrictor face 242 of the restrictor plate 214, and the outer mover face 252 of the restrictor-plate mover 216 lie in a common plane. The seal plate 212 blocks axial movement of the restrictor plate 214 and the restrictor-plate mover 216 away from the rotor drum 70 caused by, for example, an outward force from combustion products located within the rotor passages 72.

The inlet and outlet assemblies 10, 82 are spaced apart from the rotor drum 70 to form a gap between the rotor drum 70 and each assembly 10, 82 to control the passage of flow into and out of the rotor passages 72. In some embodiments, the assemblies 10, 82 are arranged to seal the rotor drum 70 to minimize leakage of flow out of the rotor passage 72.

In the illustrative embodiment, the inlet assembly 10 includes a single inlet port 18 and the outlet assembly 82 includes a single outlet port 84. In other embodiments, the inlet assembly 10 is formed to include a plurality of inlet ports 18 and the outlet assembly 82 is formed to include a plurality of outlet ports 84. In embodiments that include a plurality of inlet ports 18, the inlet assemblies 10 may include a plurality of restrictor plates 14 and restrictor-plate movers 16.

The rotor drum 70 is mounted for rotation about the central axis 20 relative to the inlet assembly 10 and outlet assembly 82 as suggested by arrow 92 in FIG. 2. In other embodiments, the rotor drum 70 rotates in an opposite direction. The rotor drum 70 includes an inlet end 74 and an outlet end 76. The rotor drum 70 extends axially along the central axis 20 between the inlet and outlet ends 74, 76.

The rotor drum 70 includes an outer ring 86, an inner ring 88, and a plurality of webs 90 as shown in FIG. 4. The outer ring 86, the inner ring 88, and the plurality of webs 90 cooperate to form the plurality of axially extending rotor passages 72. In the illustrative embodiment, the rotor passages 72 extend axially and generally parallel with the central axis 20. In other embodiments, the rotor passages 72 extend axially along and circumferentially about the central axis 20.

The outer ring 86 extends around the central axis 20 to form a radially outer portion of the rotor passages 72. The inner ring 88 extends around the central axis 20 and is positioned radially between the central axis 20 and the outer ring 86 to form a radially inner portion of the rotor passages 72. The plurality of webs 90 are spaced apart circumferentially and extend between and interconnect the outer ring 86 and the inner ring 88 to separate the plurality of rotor passages 72.

In the illustrative embodiment, the rotor passages 72 are generally parallel with the central axis 20 and the rotor drum 70 is rotated by a drive shaft 62. In other embodiments, the rotor passages 72 extend axially along and circumferentially around the central axis 20. In some embodiments, the rotor passages 72 are arranged to cause the rotor drum 70 to rotate as a result of the shape of the rotor passages 72 and the combustion process that occurs within the rotor passages 72.

Figure 9:
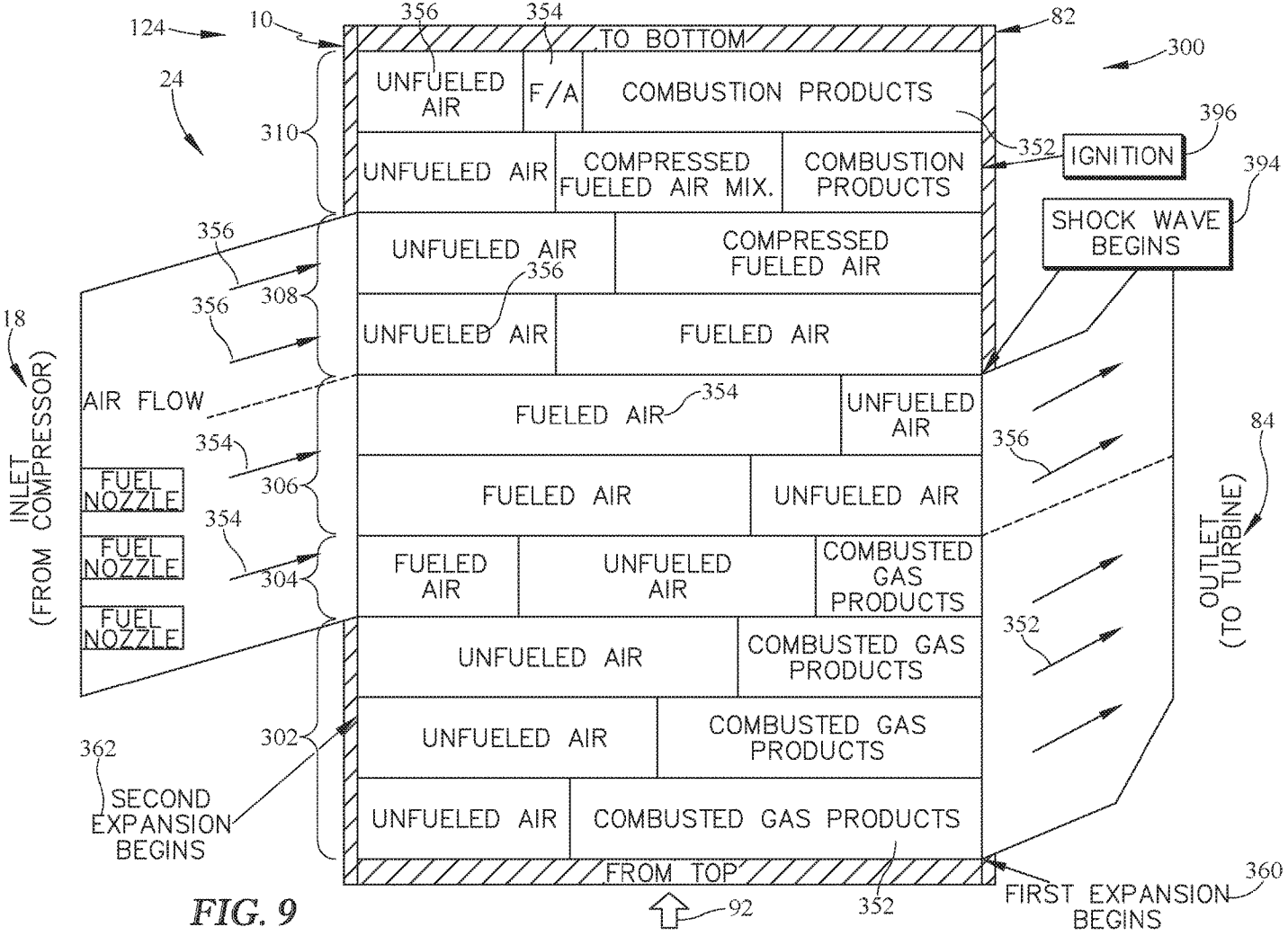
FIG. 9 is a diagrammatic view of a cycle of the combustion process that occurs within each rotor passage of the wave rotor combustor and depicts the cycle of a single rotor passage at discrete circumferential positions as it completes a revolution about the central axis.
Figure 10:
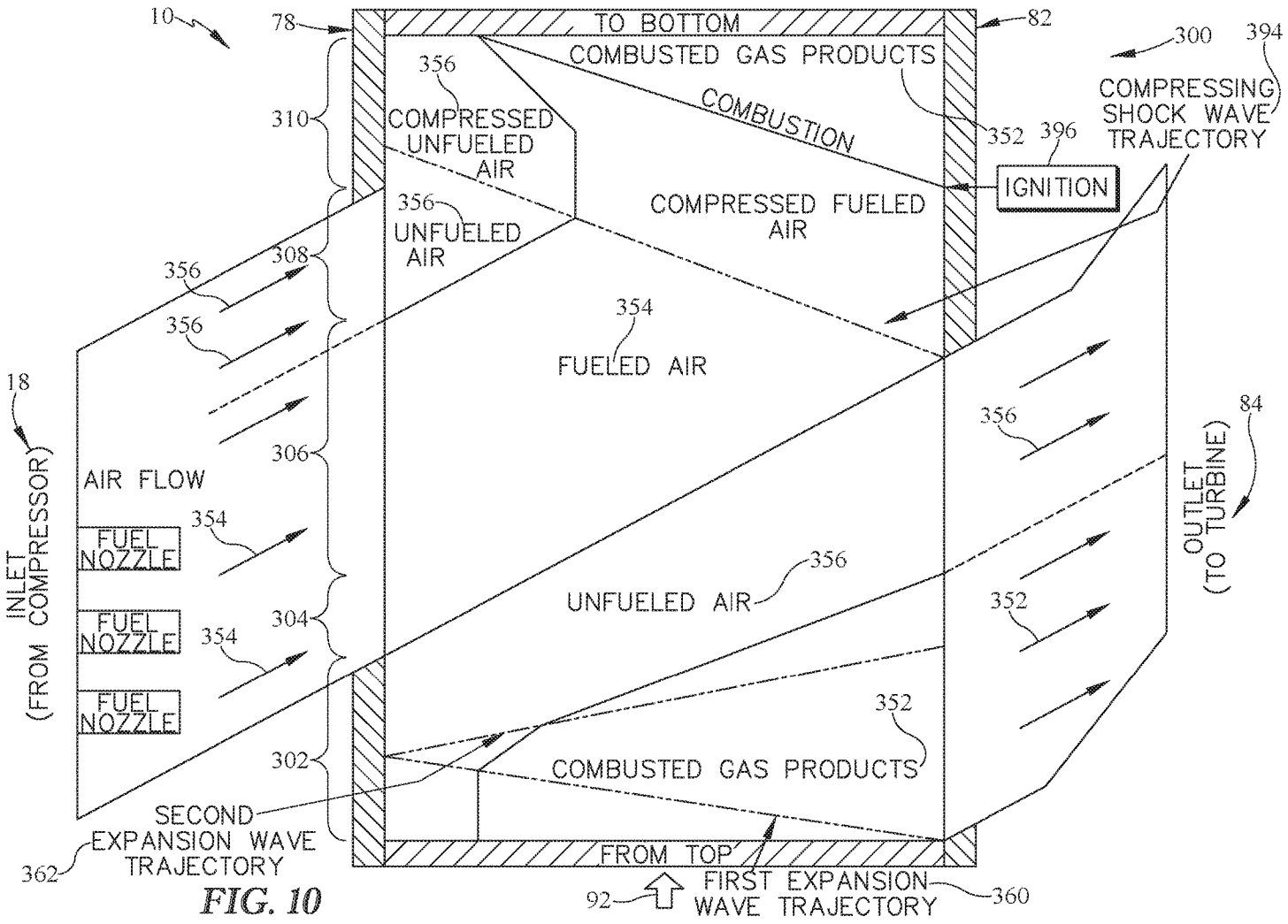
FIG. 10 is another diagrammatic view of a cycle of the combustion process that occurs within each rotor passage of the wave rotor combustor and depicts the cycle of a single rotor passage at continuous circumferential positions as it completes a revolution about the central axis.

An illustrative combustion process 300 occurs within the rotor passages 72 as the rotor passages 72 rotate about the central axis 20 as suggested in FIGS. 9 and 10. The combustion process 300 is substantially a constant volume combustion process.

The combustion process 300 occurs in each rotor passage 72 of the wave rotor combustor 124 as depicted in a space-time wave diagram shown in FIG. 9. The wave diagram shown in FIG. 9 depicts the sequence of events occurring during one cycle within a rotor passage 72 at discrete circumferential positions. The arrow 92 indicates the direction of rotation of the rotor passage 72. Upon the rotation of the rotor drum 70, each of the rotor passages 72 are sequentially brought into alignment with the inlet port 18 and the outlet port 84.

The combustion process 300 is depicted in another space-time wave diagram shown in FIG. 10. The wave diagram shown in FIG. 10 depicts the sequence of events occurring during one cycle within a rotor passage 72 in continuous circumferential positions. The arrow 92 indicates the direction of rotation of the rotor passage 72.

The combustion process 300 is periodic such that the top of each wave diagram shown in FIGS. 9 and 10 loops around and joins with its own bottom. The wave diagrams, for the purpose of description, may be started at any point. However, for convenience, the description is started at step 302 at the bottom of the wave diagrams shown in FIGS. 9 and 10.

In step 302, the inlet end 74 of the rotor passage 72 is blocked by the inlet assembly 10. The outlet end 76 of the rotor passage 72 is aligned with and opens into the outlet port 84 formed in the outlet assembly 82. The rotor passage 72 contains unfueled air 356 and combusted gas products 352. The combusted gas products 352 are hot high-pressure products resulting from the combustion of the fueled air 354.

As the rotor passage 72 opens into the outlet port 84, the combusted gas products 352 expand and exit the rotor passage 72 through the relatively low-pressure outlet port 84. A first expansion wave 360 originates from the outlet end 76 of the rotor passage 72 and propagates toward the inlet end 74 expelling the combusted gas products 352 through the outlet port 84. The combusted gas products 352 exiting the outlet port 84 are relatively hot combustion products.

As the rotor passage 72 continues to rotate, the first expansion wave 360 reaches the inlet end 74 and forms a second expansion wave 362. The second expansion wave 362 propagates from the inlet end 74 of the rotor passage 72 and propagates toward the outlet end 76 expelling the combusted gas products 352 through the outlet port 84. As such, the combusted gas products 352 continue to expand and exit through the outlet port 84 and the unfueled air 356 expands toward the outlet port 84. The combusted gas products 352 exiting through the outlet port 84 after the second expansion wave 362 are relatively cooler combustion products due to the expansion of the combusted gas products 352.

In a step 304, the rotor passage 72 aligns with and opens into the inlet port 18. The fueled air 354 is directed through the inlet port 18 into the rotor passage 72. The fueled air 354 has relatively greater pressure than the remaining unfueled air 356 and combusted gas products 352. As such, the fueled air 354 is drawn into the rotor passage 72 and the unfueled air 356 and combusted gas products 352 flow axially through the outlet port 84.

In the illustrative embodiment, the compressor 122 provides a flow of unfueled air 356 upstream of the inlet port 18. Illustratively, fuel nozzles continuously spray fuel into a portion of the flow of unfueled air 356 upstream of the inlet port 18. The fuel and air mix before entering the rotor passage 72 to form the fueled air 354. The fueled air 354 is separated from the combusted gas products 352 in the rotor passage 72 by the unfueled air 356. As such, the fueled air 354 is blocked from unintentional ignition. In the illustrative embodiment, air is used in the fueled air 354 and the unfueled air 356. In other embodiments, air may be omitted and replaced with a fuel oxidant 354 and an unfueled oxidant 356 respectively.

In a step 306, the fueled air 354 continues to be directed into the rotor passage 72 until the unfueled air 356 has been significantly expelled out of the rotor passage 72. The unfueled air 356 is relatively cooler than the combusted gas products 352. The wave rotor combustor 124 is arranged such that, as the unfueled air 356 is significantly expelled out of the rotor passage 72, the rotor passage 72 rotates beyond the outlet port 84. As a result, the outlet assembly 82 blocks the fueled air 354 from escaping through the outlet end 76 of the rotor passage 72. When the outlet end 76 of the rotor passage 72 is closed by the outlet assembly 82, a shock wave 394 begins at the outlet end 76 of the rotor passage 72 and propagates toward the inlet end 74. The shock wave 394 causes the fueled air 354 to compress.

In a step 308, the flow of fueled air 354 ends and the flow of unfueled air 356 continues to enter the rotor passage 72 due to the pressure in the rotor passage 72 being lower than the pressure at the inlet port 18. The compressing shock 394 compresses the fueled air 354 and the unfueled air 356.

In a step 310, the rotor passage 72 rotates beyond the inlet port 18 to block the flow of unfueled air 356 from entering the rotor passage 72. The fluid within the rotor passage 72 is blocked from escaping the rotor passage 72 by the seal plate 12 at the inlet end 74 and by the outlet assembly 82 at the outlet end 76. An ignition source 396 ignites the compressed fueled air 354 at the outlet end 76 of the rotor passage 72. In other embodiments, the compressed fueled air 354 ignites as a result of auto-ignition.

As the fueled air 354 combusts, the fueled air 354 expands to form the combusted gas products 352. The portion of the unfueled air 356 that did not receive fuel added by the fuel nozzle, having entered during step 308, experiences no combustion and is compressed by shock wave 394. The combusted gas products 352 expand and further compress the unfueled air 356. The rotor passage 72 continues to rotate about the central axis 20 and returns to step 302 at the bottom of the wave diagram shown in FIGS. 9 and 10.

According to an aspect of the present disclosure, a portion of a seal plate (sometimes called endplate) of a wave rotor is wedge shaped and formed to translate in a direction which is of one of the directions of a plane of the seal plate. The translation is such that the circumferential extend of an open port, an inlet or outlet port for example, of the seal plate is altered in its extent. This changes the closed portion of the seal plate and provides a variable geometry feature to the wave rotor port. One or more edges of the wedge is designed to be straight or curved and interface between it and an adjacent seal plate such that a gap therebetween is minimized or eliminated as a result of the translation. In some embodiments, the wedge may act with a second portion of the seal plate that translates circumferentially to vary the port size at a position away from the position of the wedge shaped section.

For a variable geometry feature for a wave rotor, it may be useful, for achieving desirable off design point operation, to allow altering of the circumferential position or extent of one or more ports. This may be the case for wave rotors used as pressure gain combustors in a gas turbine engine or pressure exchangers in gas turbine topping cycles. A gas seal at the end of the wave rotor with a close running clearing may be used in wave rotors. It may be desired to avoid forming a gap in the seal plate on the sealing surface. As such, it may be desired to provide variable geometry while minimizing or eliminating such a gap. A variable geometry wave rotor may provide suitable operation at rotor speeds below or above an optimal speed at some conditions.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A wave rotor combustor comprising a rotor drum mounted for rotation about a central axis of the wave rotor combustor, the rotor drum formed to include a plurality of rotor passages that extend along the central axis, the rotor drum extending between an inlet end adapted to receive a flow into the plurality of rotor passages and an outlet end adapted to emit the flow out of the plurality of rotor passages, the outlet end spaced apart from the inlet end along the central axis, and an inlet assembly positioned adjacent to the inlet end of the rotor drum, the inlet assembly comprising:

a seal plate formed to include an inlet port extending axially through the seal plate along a first arc around the central axis to allow the flow to enter one or more of the rotor passages aligned with the inlet port, a restrictor plate extending along a second arc around the central axis, the restrictor plate coupled to the seal plate to pivot about the central axis relative to the seal plate to cover selectively a portion of the inlet port and vary an area of the inlet port for the flow to pass through the seal plate, and a restrictor-plate mover mounted to translate radially inwardly and outwardly relative to the central axis the restrictor-plate mover formed to define a mover surface that is elongated and curved along a length of the restrictor-plate mover, the mover surface abutting and engaging the restrictor plate during radial translation of the restrictor-plate mover relative to the restrictor plate to cause the restrictor plate to pivot relative to the seal plate around the central axis, wherein the seal plate is fixed against rotation relative to the central axis.

2. The wave rotor combustor of claim 1, wherein a first end of the restrictor plate is positioned to cover selectively a portion of the inlet port with movement of the restrictor plate, a second opposite end of the restrictor plate is formed to define a restrictor surface for engagement with the mover surface of the restrictor-plate mover, and the restrictor surface is continuous and curved.

3. The wave rotor combustor of claim 2, wherein the restrictor surface rides along the mover surface during movement of the restrictor-plate mover relative to the restrictor plate without a gap forming between the restrictor surface and the mover surface.

4. The wave rotor combustor of claim 2, wherein the seal plate is formed to include a restrictor cutout, the restrictor plate is received in the restrictor cutout, and the restrictor plate engages with the restrictor cutout to block radial movement of the restrictor plate.

5. The wave rotor combustor of claim 4, wherein at least a portion of the restrictor-plate mover is received in the restrictor cutout and the restrictor-plate mover engages with the restrictor cutout to block circumferential movement of the restrictor-plate mover relative to the seal plate away from the inlet port.

6. The wave rotor combustor of claim 4, wherein the seal plate includes a forward face and an aft face spaced apart from the forward face and the restrictor cutout extends into the aft face of the seal plate toward the forward face of the seal plate.

7. The wave rotor combustor of claim 6, wherein the restrictor plate includes an inner restrictor face and an outer restrictor face and the restrictor plate is received in the restrictor cutout to cause the outer restrictor face of the restrictor plate and the aft face of the seal plate to lie in a common plane.

8. The wave rotor combustor of claim 4, wherein the restrictor cutout is sized to limit movement of the restrictor plate about the central axis to a predetermined number of positions.

9. The wave rotor combustor of claim 6, wherein the aft face of the seal plate is positioned adjacent to the inlet end of the rotor drum such that the restrictor plate is located axially between the rotor drum and the seal plate relative to the central axis.

10. The wave rotor combustor of claim 1, further comprising an outlet assembly positioned adjacent to the outlet end of the rotor drum, wherein the outlet assembly is formed to include an outlet port extending axially through the outlet assembly along an arc around the central axis to allow the flow to exit one or more of the rotor passages aligned with the outlet port, and the outlet assembly is fixed against rotation relative to the central axis.

11. A wave rotor combustor comprising a rotor drum mounted for rotation about a central axis of the wave rotor combustor, the rotor drum formed to include a plurality of rotor passages that extend along the central axis, the rotor drum extending between an inlet end adapted to receive a flow into the plurality of rotor passages and an outlet end adapted to emit the flow out of the plurality of rotor passages, the outlet end spaced apart from the inlet end along the central axis, and an inlet assembly positioned adjacent to the inlet end of the rotor drum, the inlet assembly comprising:

a seal plate formed to include an inlet port extending axially through the seal plate along a first arc around the central axis to allow the flow to enter one or more of the rotor passages aligned with the inlet port, a restrictor plate extending along a second arc around the central axis, the restrictor plate coupled to the seal plate to pivot about the central axis relative to the seal plate to cover selectively a portion of the inlet port and vary an area of the inlet port for the flow to pass through the seal plate, and a restrictor-plate mover mounted to translate radially inwardly and outwardly relative to the central axis, the restrictor-plate mover formed to define a mover surface that is elongated and curved along a length of the restrictor-plate mover, the mover surface abutting and engaging the restrictor plate during radial translation of the restrictor-plate mover relative to the restrictor plate to cause the restrictor plate to pivot relative to the seal plate around the central axis, wherein the seal plate is fixed against rotation relative to the central axis, the seal plate is formed to include a restrictor cutout, the restrictor plate is received in the restrictor cutout, and at least a portion of the restrictor-plate mover is received in the restrictor cutout.

12. The wave rotor combustor of claim 11, wherein a first end of the restrictor plate is positioned to cover selectively a portion of the inlet port with movement of the restrictor plate, a second opposite end of the restrictor plate is formed to define a restrictor surface for engagement with the mover surface of the restrictor-plate mover, and the restrictor surface is continuous and curved.

13. The wave rotor combustor of claim 12, wherein the restrictor surface rides along the mover surface during movement of the restrictor-plate mover relative to the restrictor plate without a gap forming between the restrictor surface and the mover surface.

14. The wave rotor combustor of claim 11, wherein the restrictor plate engages with the restrictor cutout to block radial movement of the restrictor plate.

15. The wave rotor combustor of claim 14, wherein the restrictor-plate mover engages with the restrictor cutout to block circumferential movement of the restrictor-plate mover relative to the seal plate away from the inlet port.

16. The wave rotor combustor of claim 11, wherein the seal plate includes a forward face and an aft face spaced apart from the forward face and the restrictor cutout extends into the aft face of the seal plate toward the forward face of the seal plate.

17. The wave rotor combustor of claim 16, wherein the restrictor plate includes an inner restrictor face and an outer restrictor face and the restrictor plate is received in the restrictor cutout to cause the outer restrictor face of the restrictor plate and the aft face of the seal plate to lie in a common plane.

18. The wave rotor combustor of claim 16, wherein the aft face of the seal plate is positioned adjacent to the inlet end of the rotor drum such that the restrictor plate is located axially between the rotor drum and the seal plate relative to the central axis.

19. The wave rotor combustor of claim 11, further comprising an outlet assembly positioned adjacent to the outlet end of the rotor drum, wherein the outlet assembly is formed to include an outlet port extending axially through the outlet assembly along an arc around the central axis to allow the flow to exit one or more of the rotor passages aligned with the outlet port, and the outlet assembly is fixed against rotation relative to the central axis.

20. The wave rotor combustor of claim 11, wherein the restrictor cutout is sized to limit movement of the restrictor plate about the central axis to a predetermined number of positions.

* * * * *